US005775021A

United States Patent [19]

Weiss

[11] Patent Number: 5,775,021

[45] Date of Patent: Jul. 7, 1998

[54] COLLAPSIBLE CLEANING ROD FOR FIREARMS

[76] Inventor: Michael J. Weiss, 1804 14th Ave., Sidney, Nebr. 69162

[21] Appl. No.: 781,664

[22] Filed: Jan. 10, 1997

Related U.S. Application Data

[60] Provisional application No. 60/009,897 Jan. 11, 1996.

[51] Int. Cl.[6] ..... F41A 29/00; F41A 31/00

[52] U.S. Cl. ..... 42/95

[58] Field of Search ..... 42/95; 135/65, 135/74; 15/104.16, 104.165; 248/188.6; 280/820, 823; 403/108, 109, 370

[56] References Cited

U.S. PATENT DOCUMENTS

| | | | |
|---|---|---|---|
| 883,985 | 4/1908 | Suva | 42/95 X |
| 1,348,145 | 8/1920 | Arden | 42/95 |
| 2,744,275 | 5/1956 | Geltner | 15/118 |
| 3,669,133 | 6/1972 | Hyman | 135/74 |
| 3,963,037 | 6/1976 | Clark | 135/65 |
| 4,399,627 | 8/1983 | Malesky et al. | 42/1 BC |
| 4,716,673 | 1/1988 | Williams et al. | 42/95 |
| 4,795,165 | 1/1989 | Tehan | 403/109 X |
| 5,171,925 | 12/1992 | Dan Mekler | 42/95 |
| 5,337,505 | 8/1994 | Brown et al. | 42/95 |

*Primary Examiner*—Michael J. Carone
*Assistant Examiner*—Matthew J. Lattig
*Attorney, Agent, or Firm*—Frost & Jacobs

[57] ABSTRACT

An improved collapsible sectional rod for cleaning firearms is provided. The cleaning rod includes a plurality of hollow tubular elongated sections which are preferably metallic and of substantially equal lengths. Each section includes a tapered end and a socket end configured so as to selectively receive a corresponding tapered end of an adjacently disposed elongated section. The collapsible rod further includes an elongated tubular handle having an internal volume and a plurality of internal threads. Preferably, the handle has a knurled outer surface. The collapsible rod further includes an elongated tubular tensioner having a substantially hollow internal volume. The tensioner includes an end that is substantially slidably disposed within the internal volume of the tubular handle. This slidably disposed end includes a threaded portion that is capable of selectively engaging the internal threads of the tubular handle. The collapsible rod further includes a tension cable having first and second enlarged ends. The tension cable extends substantially through the elongated sections, handle, and tensioner thereby linking these various components of the collapsible rod together. By twisting the tensioner into engagement with the internal threads of the handle, the cable is drawn taut and the various elongated segments are aligned and secured in a substantially straight end-to-end arrangement thus forming the length of the cleaning rod. The endmost elongated section is preferably threaded so as to accommodate and selectively engage a gun barrel cleaning tool.

10 Claims, 3 Drawing Sheets

COLLAPSIBLE CLEANING ROD FOR FIREARMS

This application claims priority benefit of U.S. Provisional Application No. 60/009,897, filed Jan. 11, 1996.

TECHNICAL FIELD

The present invention relates generally to gun barrel cleaning devices, and more particularly, to a gun barrel cleaning device having a collapsible sectional shaft and a tensioning component.

BACKGROUND OF THE INVENTION

Although a sportsman's firearm is typically cleaned at home, it sometimes is desirable or absolutely necessary to clean a gun barrel in a field or camp. For example, if a gun barrel bore becomes clogged with mud or snow while a sportsman is hunting, the hunter must for his own safety remove the obstruction from the barrel bore. Obviously, when a hunter has such a bore obstruction in his gun it is not convenient or expeditious for him to return home for the sole purpose of cleaning the gun barrel. Accordingly, it is frequently desirable for hunters to be able to clean their gun barrel bores in the field. Further, hunters are frequently faced with the difficult task of cleaning their gun barrel bores under a variety of adverse conditions such as while being exposed to inclement weather or under poor lighting conditions.

The firearm industry has long sought a quick, light, easy to carry, and quiet emergency cleaning rod for field cleaning firearms under adverse conditions. However, prior art cleaning rods have been largely unsuccessful because they have not been compact, full size, lightweight, versatile and/or easy to rapidly assemble under poor field conditions.

For example, U.S. Pat. No. 1,348,145, Arden, issued Aug. 3, 1920, discloses a sectionalized rod, the several sections of which are held together by an internal flexible connector capable of being drawn taut in order to assemble the various sectional components into an elongated rod through a terminal tensioning component. In order to provide the requisite tensioning to the internal flexible connector, the device disclosed in the Arden patent incorporates a relatively complex handle tensioning portion comprising many interconnected components. Specifically, the Arden tensioning portion incorporates a tubular casing housing a tension spring and an end of the internal flexible connector, a pivotally mounted lever attached to the casing, one or more studs mounted on the lower arms of the lever, and a series of spaced slots for engaging the studs and for selectively providing incremental amounts of tensioning to the internal flexible connector. When the studs are engaged in the proper slot, the lever is pivoted in order to provide the requisite tension to align and temporarily join the various cleaning rod segments.

Although the cleaning rod disclosed in Arden is capable of being stored and transported in a relatively compact fashion, it is largely incapable of being quickly assembled because of the several steps a user must perform in order to properly assemble the rod. Further, because the tensioning device used in the Arden patent comprises a large number of interdependent parts, there is a greater chance of mechanical malfunction resulting in improper tensioning of the cleaning rod, especially when used in the field under rainy and muddy conditions. Finally, the Arden cleaning rod is only capable of being tensioned with incremental amounts of tension force as dictated by the limited number of spaced slots.

Accordingly, a user of the Arden cleaning rod is unable to select the appropriate tension from essentially a continuous range of tensioning force.

It is clear that a need exists for a collapsible gun barrel cleaning rod that is capable of being deployed and used under adverse field conditions. Such a cleaning rod would comprise relatively few parts and would advantageously allow the user increased control over tension selection from essentially a continuous range of tensioning force for readily and quickly assembling the cleaning rod.

SUMMARY OF THE INVENTION

In accordance with the purposes of the present invention as described herein, an improved collapsible cleaning rod for firearms is provided. Specifically, the collapsible cleaning rod comprises a plurality of substantially hollow elongated sections. These sections are preferably of a length of between about 3 and about 6 inches. More preferably, the sections are of substantially equivalent lengths. Each section includes a tapered end and a socket end configured so as to selectively receive a corresponding tapered end of an adjacently disposed elongated section. The collapsible rod further includes an elongated handle having an internal volume and a plurality of internal threads. Preferably, the handle comprises a knurled outer surface.

The collapsible rod further includes an elongated tubular tensioner having a substantially hollow internal volume. The tensioner includes an end being substantially slidably disposed within the internal volume of the handle. This slidably disposed end includes a threaded portion that is capable of selectively engaging the internal threads of the tubular handle. The collapsible rod further includes a tension cable having first and second enlarged ends. The tension cable extends substantially through the elongated sections, handle, and tensioner thereby linking these various components of the collapsible rod together. The first enlarged end of the cable is fixedly disposed within the tensioner and the second enlarged end of the cable is fixedly disposed within the endmost elongated segment. By sliding the tensioner the cable is drawn substantially taut. After sliding the tensioner, the tautness of the cable may be further adjusted, increased, and locked in position by twisting the tensioner so as to engage the threaded end of the tensioner with the internal threads of the handle. As a result, the various elongated segments are aligned and secured in a substantially straight end-to-end arrangement thus forming the length of the cleaning rod. The various components of the collapsible rod may be comprised of any suitable material that is sufficiently durable and corrosion resistant and are further preferably of metallic composition. More preferably, the handle, tensioner and elongated segments are comprised of aluminum and the cable is comprised of stainless steel.

The endmost elongated section is preferably threaded so as to accommodate and selectively engage a gun barrel cleaning tool. In operation, when the elongated sections are assembled and the appropriate cleaning tip is secured on the last rod section, the cleaning rod can be used to clean the bore of any desired firearm. When cleaning is accomplished, the cleaning tip may be removed from the cleaning rod, the cleaning rod collapsed and these items secured within a compact and readily transportable carrying sheath.

Still other objects of the present invention will become readily apparent to those skilled in this art from the following description wherein there is shown and described a preferred embodiment of this invention, simply by way of illustration of the best mode suited to carry out the invention.

As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE PREFERRED EMBODIMENT

Figure 1:
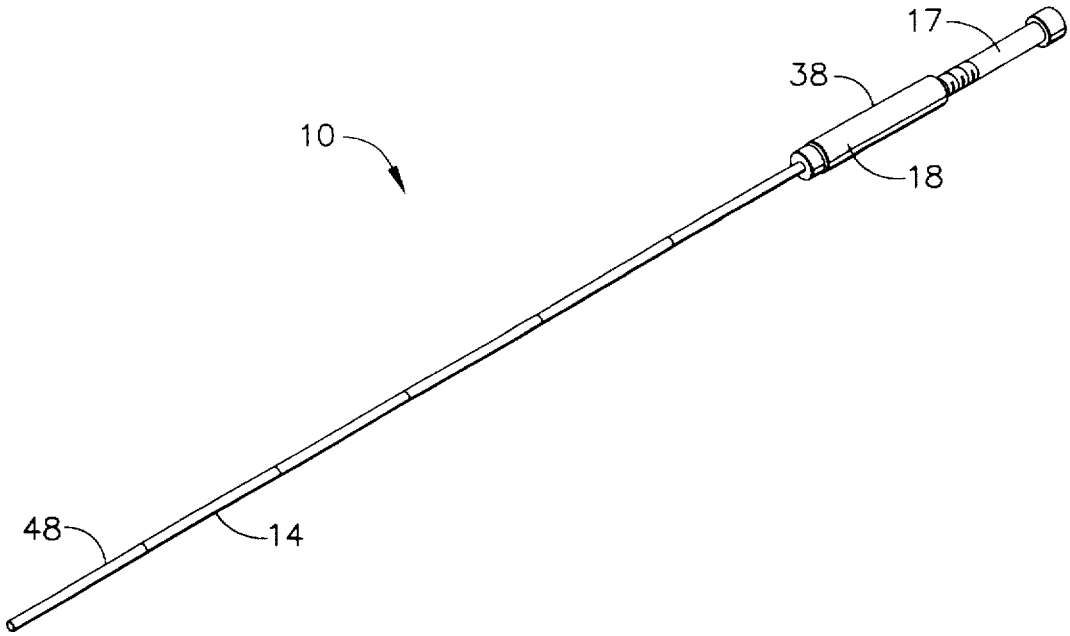
FIG. 1 is a perspective view of the collapsible cleaning rod of the present invention in an assembled configuration.

Reference is now made to FIG. 1, showing an improved collapsible gun cleaning rod of the present invention, generally indicated by the reference numeral 10, shown in its assembled position. Specifically, the collapsible cleaning rod 10 comprises a plurality of substantially hollow elongated sections 14. These sections 14 are preferably of a length of between about 3 and about 6 inches. More preferably, the sections are of substantially equivalent lengths so that the collapsed rod may be more easily stored. The entire length of the rod, when assembled, is preferably of a length of between about 12 inches and about 36 inches. Further, cleaning rod 10 is preferably comprised of between 4 and 8 sections 14. Sections 14 may be made from any suitable material that is sufficiently lightweight, corrosion resistant, durable, and of sufficient strength to withstand at least minimal tension forces. Examples of suitable materials for sections 14 include thermoplastics such as polycarbonates, nylon, or polypropylene. Preferably, sections 14 are comprised of corrosion resistant metal such as aluminum.

Figure 3A:
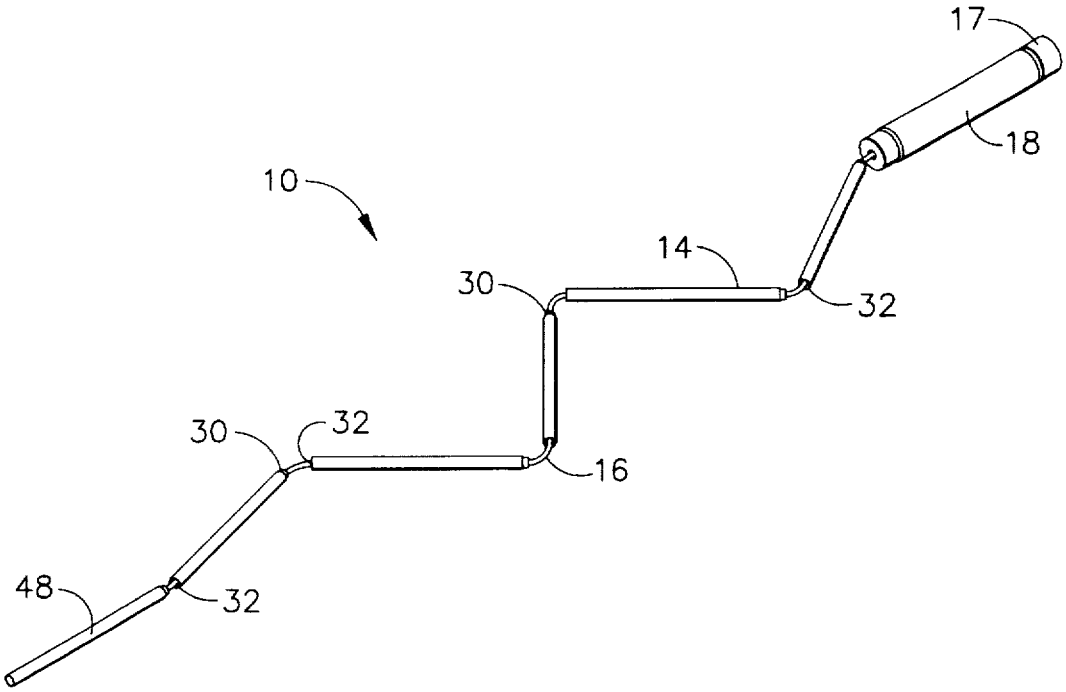
FIG. 3*a* is a perspective view of the collapsible cleaning rod of the present invention in a partially collapsed configuration.
Figure 4A:
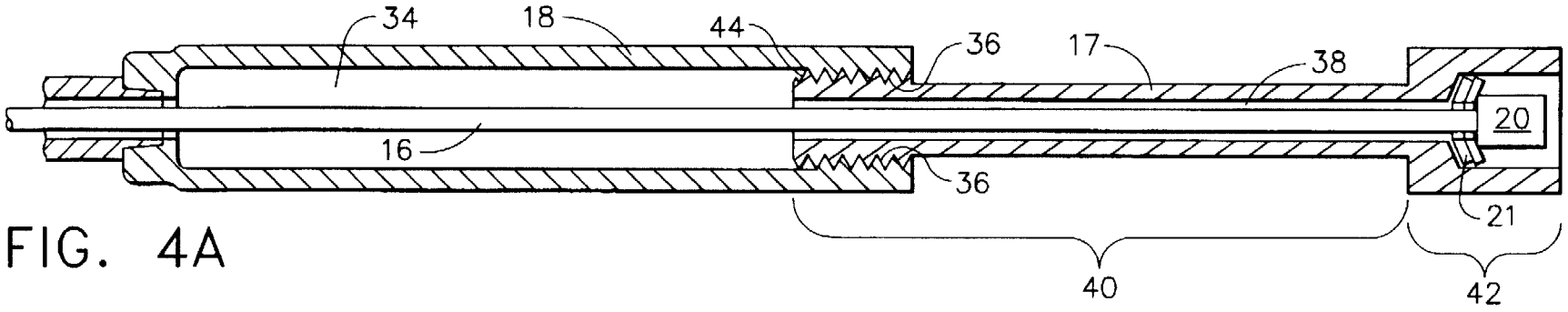
FIG. 4*a* is a partial side cross-sectional view showing the handle and tensioner of the cleaning rod of the present invention.
Figure 5:
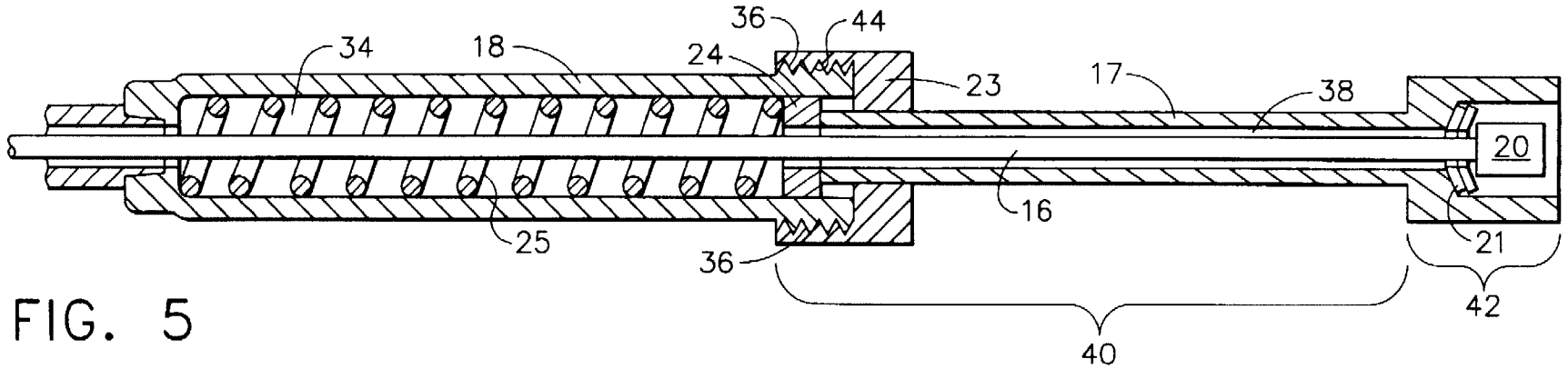
FIG. 5 is a partial side cross-sectional view of an alternative embodiment of the collapsible cleaning rod of the present invention showing a tensioning spring disposed within the handle.

As best shown in FIG. 3*a*, each section 14 includes a tapered end 30 and a socket end 32. Each socket end 32 is configured so as to selectively receive a corresponding tapered end 30 of an adjacently disposed elongated section 14. As best shown in FIGS. 1, 4*a*, and 5, The collapsible rod further includes an elongated handle 18 having an internal volume 34 and a plurality of internal threads 36. Preferably, handle 18 is substantially tubular. The handle 18 may be comprised of any suitable material that is sufficiently lightweight, corrosion resistant, and durable such as corrosion resistant metal or engineering thermoplastic. Preferably, handle 18 is comprised of aluminum and further comprises a knurled outer surface 38. This knurling advantageously allows the user to more firmly grasp the handle under adverse operating conditions.

According to an important aspect of the present invention, the collapsible rod 10 further includes an elongated tubular tensioner 17 having a substantially hollow internal volume 38. Tensioner 17 may be comprised of any suitable material that is sufficiently lightweight, corrosion resistant, durable, and of sufficient strength to withstand at least minimal tension forces. Examples of suitable materials for tensioner 17 include thermoplastics such as polycarbonates, nylon, or polypropylene. Preferably, tensioner 17 is comprised of corrosion resistant metal such as aluminum. As best shown in FIGS. 4*a* and 5, the tubular tensioner 17 includes a first segment 40 of relatively small internal and external cross-sectional diameters and a second segment 42 of relatively large internal and external cross-sectional diameters. The first segment 40 is slidably disposed substantially within the internal volume 34 of the tubular handle 18. This slidably disposed first segment 40 includes a threaded portion 44 that is capable of selectively engaging the internal threads 36 of the tubular handle 18. As shown in FIG. 5, and in an alternative embodiment of the present invention the tensioner 17 may be received within a handle cap 23 and secured within the handle 18 by a washer 24 which may push against a spring 25 to achieve the desired tension.

Figure 4B:
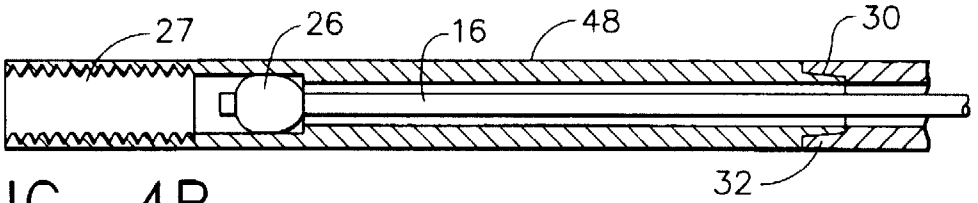
FIG. 4*b* is a partial side cross-sectional view showing the endmost section of the collapsible cleaning rod of the present invention without a cleaning tip in place.

The collapsible rod further includes a tension cable 16 having first and second enlarged ends 20, 26. The cable may be comprised of any suitable material that is sufficiently lightweight, corrosion resistant, durable, and of sufficient strength to withstand at least minimal and repetitive tension forces. Examples of suitable materials for cable 16 include corrosion resistant metals such as aluminum and stainless steel. Preferably, cable 16 is comprised of stainless steel. In order to reduce frictional wear between sections 14 and cable 16, cable 16 may be plastic or rubber coated. The tension cable 16 extends substantially through the elongated sections 14, handle 18, and tensioner 17 thereby linking these various components of the collapsible rod 10 together. As shown in FIG. 4*a*, the first enlarged end 20 of the cable 16 is preferably fixedly disposed within an internal volume 46 of the second segment 42 of the tensioner 17. Washers 21 may be employed to provide further support for enlarged end 20. As shown in FIG. 4*b*, the second enlarged end 26 of the cable 16 is fixedly disposed within the endmost elongated segment 48.

By sliding the tensioner 17 outwardly within the handle 18, the cable 16 is drawn substantially taut. After sliding the tensioner 17, the tautness of the cable 16 may be further adjusted, increased, and locked in position by twisting the tensioner 17 so as to engage the threaded portion 44 of the tensioner with the internal threads 36 of the handle 18. As a result, the various elongated segments 14 are aligned and secured in a substantially straight end-to-end arrangement thus forming the length of the cleaning rod 10.

Advantageously, this threaded arrangement allows the user to select the desired tension force from an essentially continuous range of tensions. Further, because of the relatively few number of components of the collapsible rod, the rod 10 is readily extendable and collapsible as needed in essentially one easy step, even while being subjected to adverse conditions such as low-light situations or inclement weather. Further, because the present invention is comprised of relatively few parts, the collapsible rod is capable of being manufactured with increased economic efficiency and is less susceptible to mechanical malfunction.

Figure 2A:
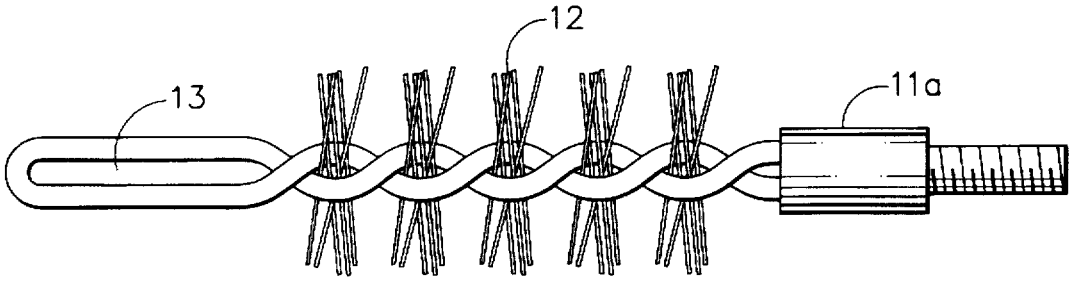
FIG. 2*a* is a side elevational view of a cleaning tip for use with the collapsible rod of the present invention comprising a brush proceeded by a patch loop.
Figure 2B:
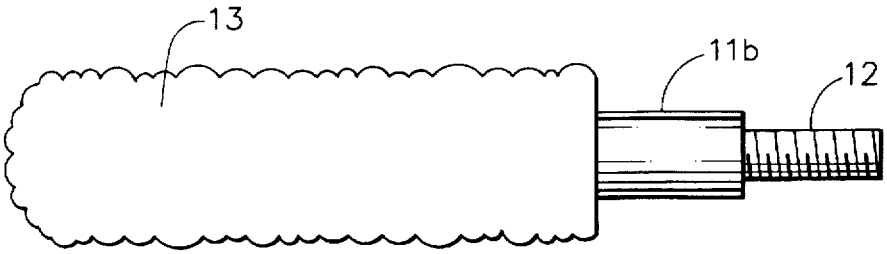
FIG. 2*b* is a side elevational view of another cleaning tip for use with the collapsible rod of the present invention comprising a rod end employing a fabric cleaning plug.
Figure 3B:
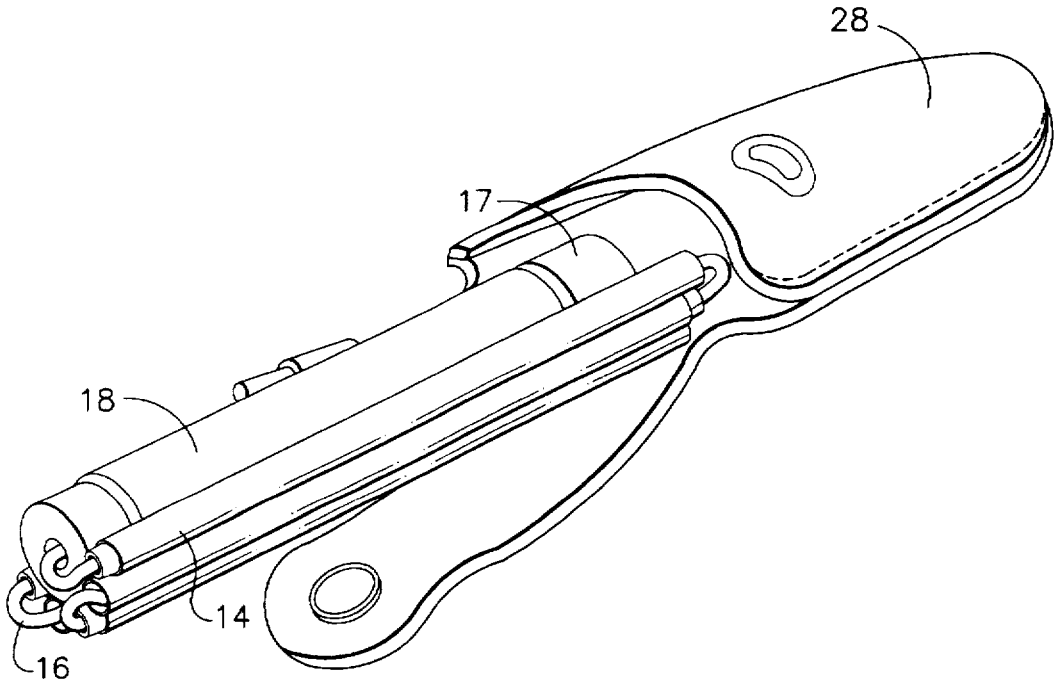
FIG. 3*b* is a perspective view of the collapsible cleaning rod of the present invention in a folded configuration for storage.

As best shown in FIG. 4*b*, the endmost elongated section 48 has threads 27 so as to accommodate and selectively engage a gun barrel cleaning tool such as one of those shown in FIGS. 2*a* and 2*b*. Suitable cleaning tips such as 11*a* and 11*b* may be secured to the endmost elongated section 48 to complete the assembly of the cleaning rod 10. The cleaning rod tip 11*a* comprises a brush 12 preceded by a patch loop 13, while the cleaning tip 11*b* comprises a rod end 12 employing a fabric cleaning plug 13. In operation, when the elongated sections 14 are assembled and the appropriate cleaning tip is secured on the last rod section 48, the cleaning rod can be used to clean the bore of any desired firearm. When cleaning is accomplished, the cleaning tip may be removed from the cleaning rod, the cleaning rod collapsed. As shown in FIG. 3*b*, these items may be secured within a compact and readily transportable carrying sheath 28.

As previously indicated, the cleaning rod 10 is shown as assembled in FIG. 1, at which time the threaded portion 27 of the endmost elongated section 48 may receive the desired cleaning element such as the cleaning tip 11*a* or 11*b*. The assembled rod 10 may then be utilized to clean the firearm. When this task is complete, the cleaning rod 10 is disassembled. This is accomplished by turning the tensioner 17 so that the threaded portion 44 of the tensioner 17 becomes disengaged from the internal threads 36 of the handle 18 and so that the cable 16 becomes slackened. The sections 14 may then be separated and the rod 10 completely disassembled as best seen in FIG. 3*b*, whereupon it may be inserted into the sheath 28.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A collapsible rod, comprising:

a plurality of substantially hollow elongated sections, each said section including a tapered end, each said tapered end having a relatively smaller cross-sectional diameter as compared with the diameter of the elongated section, each said section further including a socket end, each said socket end having a configuration shaped so as to selectively receive a corresponding tapered end of an adjacently disposed elongated section, said plurality of elongated sections, taken as a whole, further including a distal end section;

an elongated handle, said handle having a substantially hollow internal volume, said handle further including a plurality of internal threads;

an elongated tubular tensioner, said tensioner having a substantially hollow internal volume, said tensioner including a first portion of relatively small internal and external cross-sectional diameters and a second portion of relatively large cross-sectional internal and external diameters, said first portion further including a threaded end, said threaded end being capable of selectively engaging said internal threads of said elongated handle, said first portion further being substantially slidably disposed within said internal volume of said elongated handle; and a tension cable, said cable including first and second enlarged ends, said tension cable substantially extending through said plurality of elongated sections, said cable further extending substantially through said handle and said first portion of said tensioner, said first enlarged end of said cable being disposed within the internal volume of said second section of said tensioner, said first enlarged end being of greater cross-sectional diameter than the internal cross-sectional diameter of said first section of said tensioner so that said first enlarged end of said cable is fixedly held within the internal volume of said second section of said tensioner, said second enlarged end of said cable being fixedly disposed within said distal end section, so that the tautness of said cable may be selectively adjusted by engaging said threaded end of said first portion of said tensioner with said internal threads of said elongated handle in order to assemble said collapsible rod.

2. The collapsible rod of claim 1 wherein said handle further includes a longitudinally disposed tensioning spring disposed therein.

3. The collapsible rod of claim 1 wherein said distal end section of said plurality of substantially hollow elongated sections includes internal threads, said internal threads being capable of selectively engaging a gun barrel cleaning tool.

4. The collapsible rod of claim 3 wherein said elongated sections, said elongated handle, said tensioner, and said tensioning cable are all comprised of a substantially corrosion resistant material.

5. The collapsible rod of claim 4 wherein said elongated sections, said handle portion, and said tensioner are all comprised of aluminum.

6. The collapsible rod of claim 5 wherein said tensioning cable is comprised of stainless steel.

7. The collapsible rod of claim 4 wherein said elongated handle comprises a substantially knurled outer surface.

8. The collapsible rod of claim 7 wherein said elongated handle is substantially tubular.

9. The collapsible rod of claim 4 wherein each said section of said plurality of sections is between about 3 and about 6 inches in length.

10. The collapsible rod of claim 9 wherein said plurality of sections are comprised of sections of substantially equivalent lengths.

* * * * *